US012532936B1

(12) United States Patent
Lu

(10) Patent No.: US 12,532,936 B1
(45) Date of Patent: Jan. 27, 2026

(54) HELMET WITH NOSE BRIDGE PROTECTION

(71) Applicant: SHAOXING RIF SPORTS GOODS CO., LTD., Shaoxing (CN)

(72) Inventor: Dejian Lu, Shaoxing (CN)

(73) Assignee: SHAOXING RIF SPORTS GOODS CO., LTD., Shaoxing (CN)

( * ) Notice: Subject to any disclaimer, the term of this patent is extended or adjusted under 35 U.S.C. 154(b) by 0 days.

(21) Appl. No.: 18/947,716

(22) Filed: Nov. 14, 2024

(30) Foreign Application Priority Data

Oct. 22, 2024 (CN) ..... 202422553128.2

(51) Int. Cl.
*A42B 3/12* (2006.01)
*A42B 3/18* (2006.01)

(52) U.S. Cl.
CPC . *A42B 3/18* (2013.01); *A42B 3/12* (2013.01)

(58) Field of Classification Search
CPC .. A42B 3/12; A42B 3/18; A42B 3/065; A42B 3/068
See application file for complete search history.

(56) References Cited

U.S. PATENT DOCUMENTS

| | | | | |
|---|---|---|---|---|
| 10,834,987 | B1 * | 11/2020 | Bottlang | A42B 3/125 |
| 11,253,021 | B2 * | 2/2022 | Saijo | A42B 3/127 |
| 2014/0223641 | A1 * | 8/2014 | Henderson | A42B 3/065 2/411 |
| 2023/0010873 | A1 * | 1/2023 | Storey | A42B 3/124 |
| 2023/0011532 | A1 * | 1/2023 | Storey | A42B 3/124 |
| 2025/0234951 | A1 * | 7/2025 | Whyman | A42B 3/06 |

* cited by examiner

*Primary Examiner* — Katherine M Moran
(74) *Attorney, Agent, or Firm* — Schwegman Lundberg & Woessner, P.A.

(57) ABSTRACT

A helmet with nose bridge protection, which relates to related technical field of helmets and includes a shell. An inner side of the shell is connected with an inner layer, a nose bridge groove is provided at a lower side of the inner layer, and the inner layer is provided with a deformation zone at the nose bridge groove. In the disclosure, a nose bridge of a user is accommodated by the nose bridge groove, so that secondary injury is prevented when the nose bridge contacts the helmet in an accident process, and further adjustment can be made through the deformation zone, and a shape of the deformation zone is changed in a collapsed form when impacted to wrap the nose bridge, thus achieving buffer effect, protecting the nose bridge, and improving safety.

7 Claims, 4 Drawing Sheets

HELMET WITH NOSE BRIDGE PROTECTION

CROSS-REFERENCE TO RELATED APPLICATION

This non-provisional application claims priority under 35 U.S.C. § 119 (a) on Chinese Patent Application No(s). 202422553128.2 filed on Oct. 22, 2024, the entire contents of which are hereby incorporated by reference.

TECHNICAL FIELD

The disclosure relates to related technical field of helmets, in particular to a helmet with nose bridge protection.

BACKGROUND ART

In existing outdoor sports, in order to ensure safety of athletes, most of the athletes may wear helmets for protection to reduce impact on their heads. In some special sports, an athlete may not only fall and slide, but also roll in an accident, in which case the helmet may move forward in a process of continuous moving, and then the helmet may slide on the head and is easy to contact an athlete's nose, thus causing damage to the nose.

SUMMARY

Object of the disclosure: an object of this disclosure is to provide a helmet with nose bridge protection, which solves a problem that the helmet slides during use and causes damage to a user's nose bridge.

Technical scheme: the helmet with nose bridge protection includes a shell. An inner side of the shell is connected with an inner layer, a nose bridge groove is provided at a lower side of the inner layer, and the inner layer is provided with a deformation zone at the nose bridge groove. Upon impact, the deformation zone collapses to wrap and protect the user's nose bridge.

Preferably, a spacing chamber is remained between the inner layer and the shell.

Preferably, both the inner layer and the deformation zone are made of an EPS material, and density of the deformation zone is smaller than that of the inner layer.

Preferably, a plurality of supporting protrusions are provided at a top of the inner layer, and the supporting protrusions are in a shape of a circular truncated cone.

Preferably, a groove is provided at an inner wall of the inner layer, and the groove and the nose bridge groove are respectively located at two ends of the inner layer.

Preferably, the shell is made of an ABS material.

Preferably, an outer surface of the shell is provided with a top cover, and a penetrating vent is provided at a peripheral side of the shell at a joint of the top cover.

Preferably, the deformation zone and the inner layer are connected by a dividing line.

The disclosure has advantages that a nose bridge of a user is accommodated by the nose bridge groove, so that secondary injury is prevented when the nose bridge contacts the helmet in an accident process, and the nose bridge is protected by the deformation zone through further adjustment by the deformation zone, thus improving safety.

Figure 1:
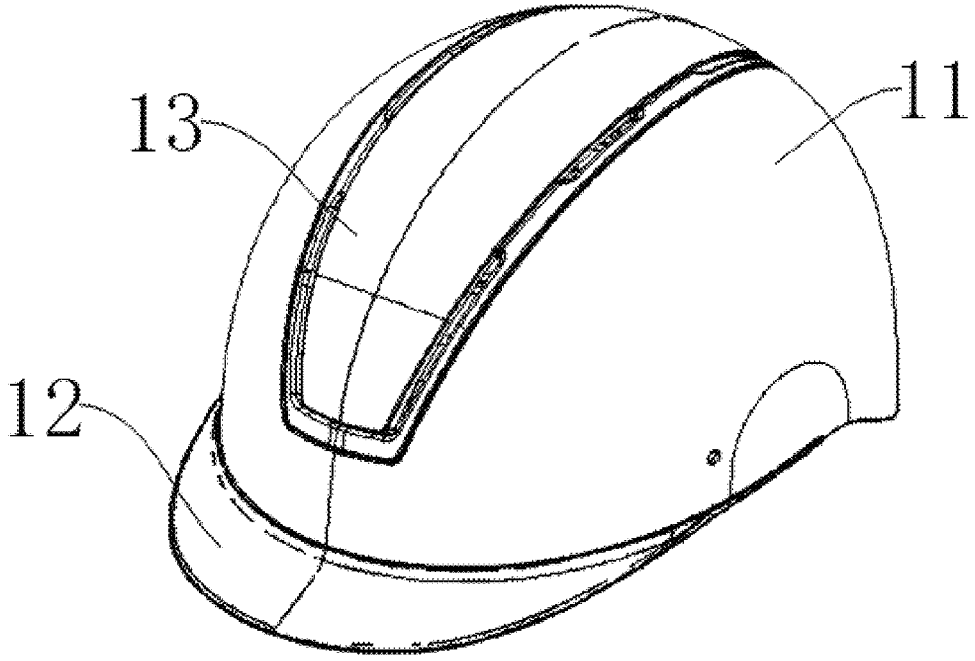
FIG. 1 is a schematic view of an overall structure according to the disclosure.

Reference numerals in the figures are as follows: 11. Shell; 12. Brim; 13. Top Cover; 21. Dividing Line; 22. Nose Bridge Groove; 23. Inner Layer; 24. Deformation Zone; 25. Inner Cavity; 26. Support Protrusions; 27. Groove; 28. Spacing Chamber.

DETAILED DESCRIPTION

In order to make technical schemes of the disclosure more clear, the disclosure will be further explained in detail in the following in combination with drawings and specific examples.

Embodiment 1

As shown in FIG. 1, a helmet with nose bridge protection includes a shell 11, which is in a common arc shape to better protect a user, and an inner side of the shell 11 is connected with an inner layer 23, and a space for accommodating a user's head is remained at the inner layer 23.

A front section of the shell 11 is connected with a brim 12.

The shell 11 is made of an ABS material, and ABS plastic can be a terpolymer of three monomers, acrylonitrile (A), butadiene (B) and styrene(S), and relative contents of these three monomers can be changed at will to make various resins, which is a "tough, hard and rigid" material with easily available raw materials, good comprehensive performance, low price and wide application. The inner layer 23 is made of an EPS material, that is, an EPS foam material, which is an efficient thermal insulation material with characteristics of light weight, high efficiency and environmental protection. In the disclosure, the shell 11 and the inner layer 23 are integrally formed, with closer connection.

Figure 4:
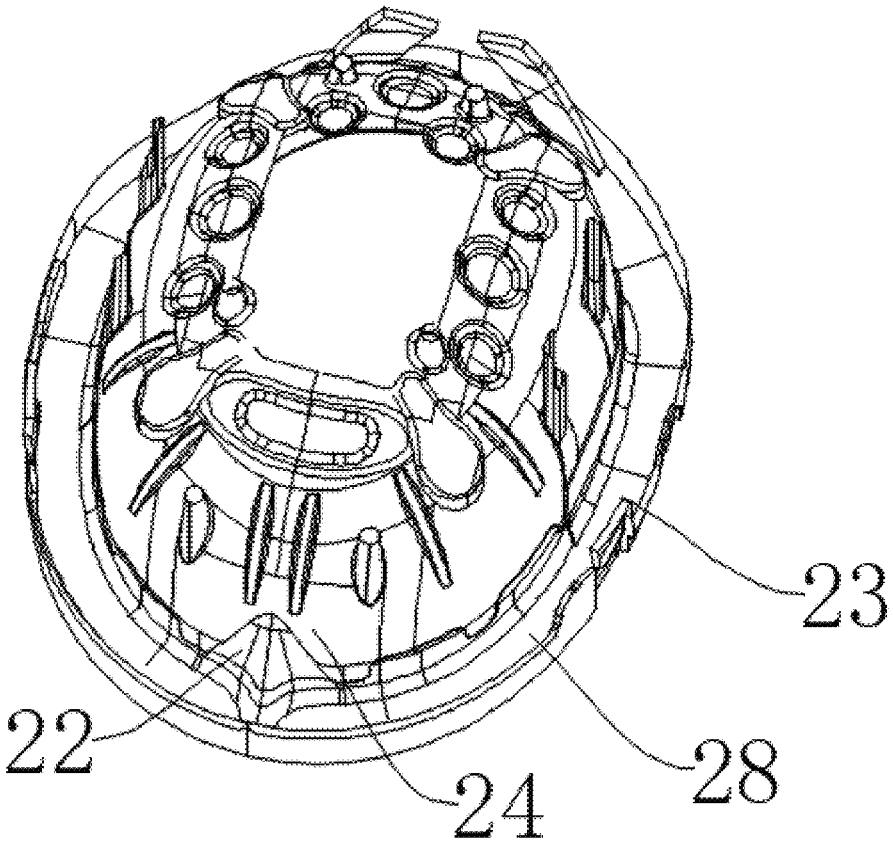
FIG. 4 is a schematic structural sectional view of an inner layer according to the disclosure.

As shown in FIG. 4, a spacing chamber 28 is remained between the inner layer 11 and the shell 23, and a protective sheet can be placed in the spacing chamber 28, which further enhances use strength of the shell 11 through the protective sheet and improves the safety.

Meanwhile, a top cover 13 is provided at an outer surface of the shell 11, and the top cover 13 is arc-shaped and embedded in the outer surface of the shell 11, and a penetrating vent is provided at a peripheral side of the shell 11 at a joint of the top cover 13. The top cover 13 may affect a sliding speed of the helmet on the ground to a certain extent, thus improving the safety of the helmet.

The helmet may slide forward along the user's head due to accidental activities during use, and an inner side of the brim 12 at the front section of the helmet is easy to contact a user's nose. In this disclosure, a nose bridge groove 22 is provided at a lower side of the inner layer 23, and when the helmet slides, the nose bridge groove 22 is configured to accommodate the user's nose, and contact two sides of a user's face through the inner side of the brim 12, that is, inner walls at both ends of the nose groove 22, so that the nose bridge is not damaged.

Figure 2:
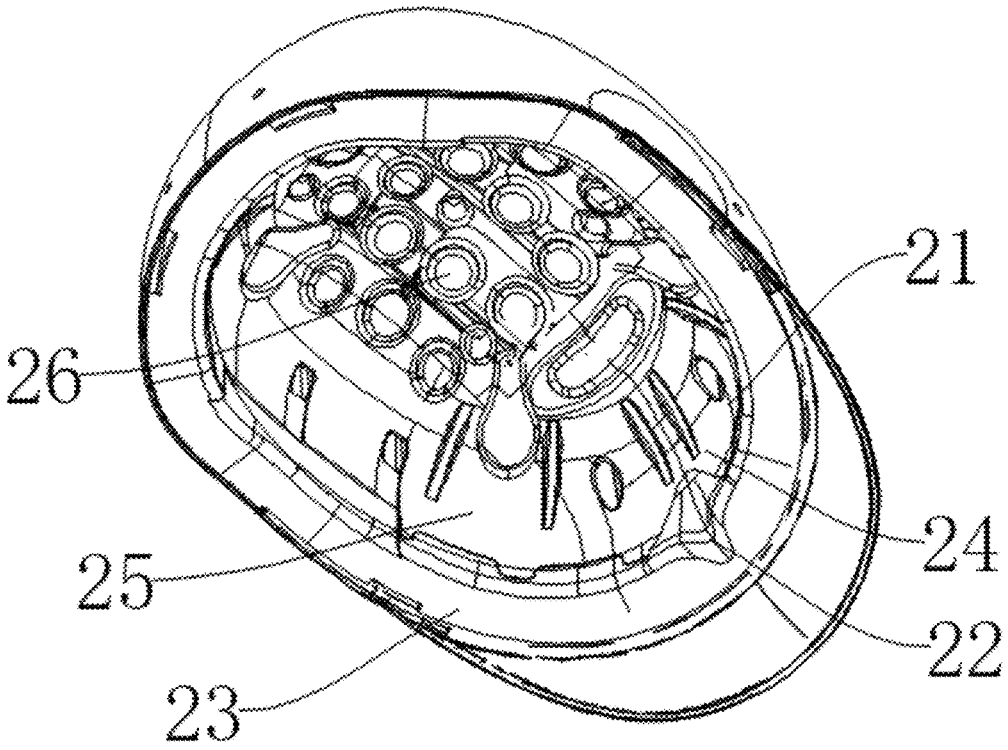
FIG. 2 is a schematic structural view of an inner layer according to the disclosure.

As shown in FIG. 2, further, the inner layer 23 is provided with a deformation zone 24 at the nose bridge groove 22, and both the deformation zone 24 and the inner layer 23 are made of an EPS foam material, but density of the EPS material of the deformation zone 24 is different from that of the inner layer 23, and thus density of the deformation zone 24 is smaller than density of the inner layer 23. When an accident occurs, the deformation zone 24 is easy to collapse, thus wrapping the user's nose bridge and reducing damage caused by secondary impact.

There is still a dividing line 21 between the deformation zone 24 and the inner layer 23, and the dividing line 21 is a part with weak connection between them. With too large impact, the deformation zone 24 and the inner layer 23 can be separated to reduce the secondary impact.

Further, the nose bridge groove 22 can further be connected with a silica gel pad, which is flexible and may deform and fit to the nose bridge with impact to protect the nose bridge.

Figure 3:
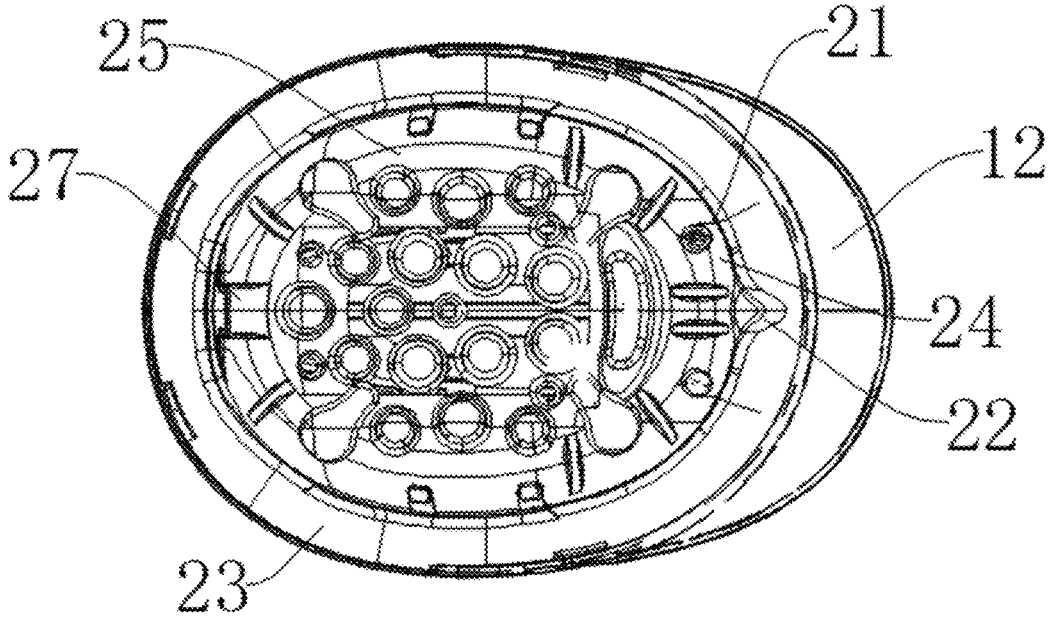
FIG. 3 is a schematic structural top view of an inner layer according to the disclosure.

As shown in FIG. 3, meanwhile, a groove 27 is further provided on an inner wall of the inner layer 23, the groove 27 and the nose bridge groove 22 are located at both sides of the inner layer 23 of the helmet, respectively. The nose groove 22 is located in the front section and the groove 27 is located in a rear section. When the helmet moves, the groove 27 contacts a back of the user's head, which slows down the helmet sliding forward and protects the user.

A plurality of supporting protrusions 26 are provided at a top of the inner layer 23, and the plurality of supporting protrusions 26 are in contact with a top of the user's head, and the supporting protrusions 26 are arranged at intervals, and the inner layer 23 is provided with penetrating air holes at intervals between the supporting protrusions 26, thereby increasing air permeability and providing better wearing experience.

The above described embodiments only express several implementations of the present disclosure, and their descriptions are more specific and detailed, but they cannot be constructed as limiting a scope of the present invention. It should be noted that, several modifications and improvements can be made by those of ordinary skill in the art without departing from the concept of the present disclosure, which belong to the protection scope of the present disclosure. Therefore, the protection scope of this disclosure shall be subjected to appended claims.

What is claimed is:

1. A helmet with nose bridge protection, comprising a shell, wherein an inner side of the shell is connected with an inner layer, a nose bridge groove is provided at a lower side of the inner layer, and the inner layer is provided with a deformation zone at the nose bridge groove;

wherein, upon impact, the deformation zone collapses to wrap and protect the user's nose bridge;

wherein a groove is provided at an inner wall of the inner layer, and the groove and the nose bridge groove are respectively located at two ends of the inner layer.

2. The helmet with nose bridge protection according to claim 1, wherein a spacing chamber is remained between the inner layer and the shell.

3. The helmet with nose bridge protection according to claim 1, wherein both the inner layer and the deformation zone are made of an EPS material, and density of the deformation zone is smaller than that of the inner layer.

4. The helmet with nose bridge protection according to claim 1, wherein a plurality of supporting protrusions are provided at a top of the inner layer, and the supporting protrusions are in a shape of a circular truncated cone.

5. The helmet with nose bridge protection according to claim 1, wherein the shell is made of an ABS material.

6. The helmet with nose bridge protection according to claim 1, wherein an outer surface of the shell is provided with a top cover, and a penetrating vent is provided at a peripheral side of the shell at a joint of the top cover.

7. The helmet with nose bridge protection according to claim 1, wherein the deformation zone and the inner layer are connected by a dividing line.

* * * * *